US008915583B2

(12) United States Patent
Edwards et al.

(10) Patent No.: US 8,915,583 B2
(45) Date of Patent: Dec. 23, 2014

(54) SYSTEMS, METHODS, AND MATERIALS FOR TEMPORARY PRINTING AND INDICIA

(75) Inventors: David N. Edwards, Pasadena, CA (US); Ali R. Mehrabi, Glendale, CA (US); Haochuan Wang, S. Pasadena, CA (US); Juan M. De Santos Avila, Temple City, CA (US); Pradeep S. Iyer, Hacienda Heights, CA (US); Liviu Dinescu, Chatsworth, CA (US); Srikant Pathak, Diamond Bar, CA (US); Nagarajan Srivatsan, Arcadia, CA (US); Frank Y. Shih, Arcadia, CA (US)

(73) Assignee: Avery Dennison Corporation, Glendale, CA (US)

( * ) Notice: Subject to any disclaimer, the term of this patent is extended or adjusted under 35 U.S.C. 154(b) by 549 days.

(21) Appl. No.: 12/472,841

(22) Filed: May 27, 2009

(65) Prior Publication Data

US 2009/0295851 A1 Dec. 3, 2009

Related U.S. Application Data

(60) Provisional application No. 61/056,380, filed on May 27, 2008.

(51) Int. Cl.

| | |
|---|---|
| ***B41J 2/01*** | (2006.01) |
| ***B41M 5/00*** | (2006.01) |
| ***B41J 2/21*** | (2006.01) |

(52) U.S. Cl.

CPC ..... *B41M 5/0023* (2013.01); *B41J 2/2107* (2013.01)

USPC ..... 347/100; 347/95

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21

USPC ..... 347/101, 100, 102, 103, 95, 96; 106/31.6, 31.13, 31.27; 523/160, 161; 283/117

See application file for complete search history.

(56) References Cited

U.S. PATENT DOCUMENTS

| | | | | |
|---|---|---|---|---|
| 5,415,982 | A * | 5/1995 | Deguchi | 430/385 |
| 5,677,363 | A * | 10/1997 | Imagawa | 523/161 |
| 5,678,157 | A * | 10/1997 | Yoshida et al. | 399/390 |
| 5,736,286 | A * | 4/1998 | Kaneko et al. | 430/124.15 |
| 6,017,386 | A * | 1/2000 | Sano et al. | 106/31.32 |
| 7,851,409 | B1 * | 12/2010 | Xu | 503/201 |
| 2001/0008164 | A1 * | 7/2001 | Sano et al. | 156/221 |
| 2002/0175982 | A1 * | 11/2002 | Isago | 347/100 |
| 2003/0043189 | A1 * | 3/2003 | Rieffel et al. | 345/753 |
| 2003/0232903 | A1 * | 12/2003 | Sato et al. | 523/160 |
| 2005/0191082 | A1 * | 9/2005 | Takayama et al. | 399/101 |
| 2006/0212813 | A1 * | 9/2006 | Yalovsky et al. | 715/700 |
| 2009/0258156 | A1 * | 10/2009 | Chretien et al. | 106/31.92 |
| 2010/0225722 | A1 * | 9/2010 | Elrod et al. | 347/102 |

* cited by examiner

*Primary Examiner* — Manish S Shah

(74) *Attorney, Agent, or Firm* — Avery Dennison Corporation

(57) ABSTRACT

Methods and/or systems for printing or otherwise evincing temporary indicia on media with disappearing inks are described along with suitable disappearing ink formulations and media constructions for executing the same. In particular embodiments, the methods and/or systems described employ a plurality of disappearing inks with different disappearing rates. In one embodiment, a barrier layer that is selectively used to cover a major surface of the media is employed to substantially block or otherwise regulate a rate of phase transitions (e.g., evaporation and/or sublimation) experienced by ink borne by the media.

11 Claims, 3 Drawing Sheets

SYSTEMS, METHODS, AND MATERIALS FOR TEMPORARY PRINTING AND INDICIA

CROSS-REFERENCE TO RELATED APPLICATION

This application claims the benefit of U.S. Provisional Patent Application No. 61/056,380 filed May 27, 2008, which is incorporated herein by reference in its entirety.

TECHNICAL FIELD

This disclosure relates to systems, methods and materials for temporarily printing onto a substrate and for temporary fluid-activated indicia.

BACKGROUND

Despite the advent of "electronic offices" and/or the wide availability of electronic media, a large number of documents are still printed or otherwise output on paper and/or other like media, both in offices and elsewhere. Accordingly, the attendant cost of materials (e.g., such as paper, ink, etc.) can also be significant. However, many of printed documents have a relatively short useful lifespan, e.g., measuring a number hours or less. A handout for a meeting that is intended to be disposed of at the end of the meeting is a good example of a document with a limited useful lifespan. A newspaper is another example of a document that often has a limited useful lifespan. That is to say, once an individual reads a newspaper, they generally have little further use for it.

Accordingly, it would be desirable to have a method and/or system for reducing the amount of paper and/or other like media wasted on printouts that are intended to be used for only a short or limited period of time and disposed of thereafter. In particular, methods and/or materials for creating and/or evincing temporary indicia on a media would be advantageous. The embodiments of the present disclosure address these and/or other issues.

SUMMARY OF THE DISCLOSURE

Figure 1:
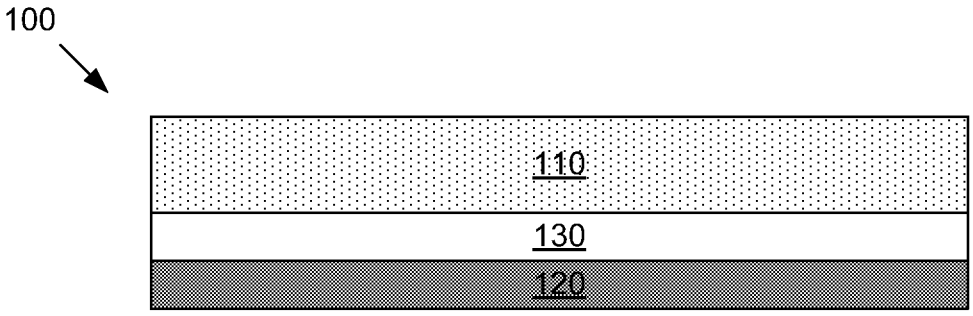
FIG. 1 of the present specification is a side view of a substrate for printing upon in accordance with the present disclosure.

In one embodiment disclosed herein, a method comprises selecting a formulation for an ink comprised of ingredients selected to cause the ink to evaporate or sublimate upon deposition onto a surface; and preparing a plurality of individual amounts of ink in accordance with the formulation, each individual amount of ink including a different ratio of ingredients than the other individual amounts of ink to evaporate or sublimate upon deposition onto a surface at a different rate than the other individual amounts of ink.

In another embodiment disclosed herein, a method comprises providing a printer having a plurality of individually selectable ink reservoirs; and disposing an amount of ink in each reservoir, the ink deposited in each reservoir being formulated with a different ratio of ingredients than the other individual amounts of ink to cause the ink to evaporate or sublimate upon deposition onto a surface at a different rate than the inks deposited in the other reservoirs.

In a further embodiment disclosed herein, a method of printing temporarily comprises selecting a sheet formed with a colored layer covered by an opaque coating that becomes at least translucent and at most transparent when wetted by a liquid; applying a liquid ink to the coating, the ink formulated to substantially fully evaporate or sublimate over a selected period of time; and applying a barrier layer over the opaque coating.

In a still further embodiment disclosed herein, a printer comprises means for printing onto a sheet; and means for disposing a layer onto the printed sheet.

These and other features and advantages will become further apparent from the detailed description and accompanying figures that follow. In the figures and description, numerals indicate the various features, like numerals referring to like features throughout both the drawings and the description.

DETAILED DESCRIPTION

The present disclosure provides for an ink formulation that, when deposited onto a surface (i.e., printed), will substantially completely evaporate or sublimate over time to effectively disappear from the surface onto which it has been printed. Such disappearing inks are typically printed onto and/or used in conjunction with specially formulated paper or media. For example, this paper or media is typically formed with a porous layer having regions of high and low refraction indices which scatters the light and renders opaque overlying a colored layer. The aforementioned overlying layer is generally configured to reduce the light scattering when the disappearing ink is printed thereon, thereby turning substantially translucent or transparent so as to expose the colored layer underneath. As the ink evaporates, the light scattering of the top layer increases and becomes opaque (again hiding the underlying colored layer), at which point the paper or media can be printed upon again.

Disappearing inks are formulated with at least one ingredient that enables and/or assists the evaporation or sublimation effect to occur. The present disclosure recognizes that by varying the formulation of the ink, the rate at which the evaporation or sublimation takes place is likewise varied. Therefore, in accordance with the present disclosure, a method of printing upon reusable paper or media with disappearing ink involves the provision of a plurality of different disappearing inks. In particular, each ink is formulated to exhibit a specific rate of evaporation or sublimation which is different from the others. Accordingly, each ink takes a different amount time to "disappear." In this manner, a user of the paper or media can select the most desirable time of disappearance for each print job, thereby further enhancing the ease of use of such reusable media. For instance, a memo that only has to be referred to for a short meeting can be printed with ink formulated to disappear within 30 minutes, whereas a memo that a user desired to take home and read overnight could be printed with ink formulated to disappear within 12 hours. By selecting the appropriate lifetime for the printed matter, the user can more easily recycle the paper/media and can also ensure that the printed matter does not disappear too quickly (which would be highly inconvenient) or too slowly (which could pose security risks).

It is to be appreciated that suitable embodiments for practicing the presently disclosed inventive subject matter are not limited to specific methods of printing or marking. Indeed, any and all practicable methods of printing and/or marking may be employed in accordance with various embodiments. For example, inks with different disappearing times could be loaded into one or more manual writing instruments (i.e., such as pens, markers, etc.) and they could be provided to end users for handwriting and/or drawing. Alternatively, inks with different disappearing times could be loaded, e.g., into ink cartridges or the like, for use in printers or other like marking engines (e.g., such as inkjet devices, etc.). Accordingly, one or more cartridges or other like containers (each having a different ink with a different disappearing time contained therein) can accordingly be loaded into and/or otherwise provided in the device so as to allow a user to selectively print or otherwise output text, graphics, pictures and/or other information (i.e., indicia) on specially formulated paper or other like selected output media using one or more of the available disappearing inks from the cartridges loaded/provided in the device. In this manner, the disappearance time of the various indicia so printed or output can be controlled as desired by appropriate ink selection.

Notably, otherwise conventional multi-color inkjet printers, marking engines and/or the like are generally configured and/or equipped to accept and/or receive a plurality of ink cartridges simultaneously. For example, a typical multi-color device may be capable of accepting up to four ink cartridges usually associated with different colors of ink, e.g., such as black, cyan, magenta, and yellow. In one suitable embodiment, rather than loading or otherwise providing different color ink cartridges in the currently available devices in the known manner, one or more of the cartridges is optionally replaced with a cartridge containing one or more of the differently formulated disappearing inks (i.e., with different disappearing times). In this manner, a user could selectively control the disappearing times for various output indicia by simply selecting the appropriate "color" for the indicia, which now in fact, corresponds to the ink cartridge having the desired disappearing time. For example, if the location in the device that usually receives a cyan color ink cartridge, is loaded with a cartridge having disappearing ink with a disappearing time of about 6 hours, then to print or output indicia which remains on the output media for roughly 6 hours, the user would simply designate that the indicia be output in "cyan" thereby effectively selecting the cartridge containing the desired disappearing ink. Similarly, the location in the device that usually receives a magenta color ink cartridge may be loaded with a cartridge having disappearing ink with a disappearing time of about 12 hours. Accordingly, to print or output indicia which remain on the output media for roughly 12 hours, the user would simply designate that the indicia be output in "magenta" thereby effectively selecting the cartridge containing the desired disappearing ink. Likewise, the location in the device that usually receives a yellow color ink cartridge may be loaded with a cartridge having disappearing ink with a disappearing time of about 24 hours. Accordingly, to print or output indicia which remain on the output media for roughly 24 hours, the user would simply designate that the indicia be output in "yellow" thereby effectively selecting the cartridge containing the desired disappearing ink.

In a further embodiment in which inks with different disappearing times are printed or output on a compatible output media with a multi-cartridge printer or other like device, the device is optionally configured (e.g., either via software or hardware or firmware or some combination thereof) to acquire the disappearing time of each ink loaded therein. For example, the disappearing time of each loaded ink may be manually input by the user; or the device may automatically analyze or test the ink directly to determine its disappearing time; or the device may print or output test samples on the output media and analyze, test or otherwise detect the disappearance time of the ink based upon the output sample; or the cartridge may include information or be so shaped or include a tab or other physical indication that communicates to the device the disappearing time of the ink contained therein. In any event, upon receiving a print or other like job indicating a desired disappearing time for more or more indicia of the job that does not correspond to the rated disappearing time of any of the inks loaded therein, the device is optionally provisioned to selectively draw ink from a plurality of the cartridges to thereby create a custom-blended ink evincing the desired disappearing time. For example, such custom blending of inks may be based upon an algorithm that takes into account empirical data defining the disappearing time of each ink. Such an algorithm could be implemented in the device software or hardware, or alternatively in the word processing or other job creation software or device driver software outputting and/or processing the job.

An effect that can occur when printing with a disappearing ink as described herein on a paper or media having a porous top layer is that larger indicia (and thus using more ink) may tend to disappear over a longer period of time compared to relatively smaller indicia (that uses relatively less ink). For example, text printed in bigger fonts may tend to disappear over a longer period of time than text printed in comparatively smaller fonts. This may prove undesirable when printing a document containing a wide range of indicia including sizes large and small, because the smaller sized indicia would tend to disappear before the larger sized indicia. To counteract this effect, one embodiment in accordance with the present disclosure provides a printer or other like marking engine that selects one of a plurality of inks having different disappearing times based upon the size of each individual character or graphic or other indicia in a job it receives, so as to achieve a substantially equal disappearing time for the entire job. In a further embodiment, the printer is optionally configured to custom blend the various inks to achieve nearly equal disappearing times for all printed matter, as described previously. Of course, in some cases, it may be desired that different indicia in a job disappear at different times. As can be appreciated, the device may be selectively controlled to regulate ink selection and/or blending to achieve a plurality of different disappearance times for different indicia in a job, optionally, adjusting for the size of the respective indicia. Again, these embodiments can be optionally implemented in the device software or hardware, or alternatively in the word processing or other job creation software or device driver software outputting and/or processing the job.

In still another embodiment in accordance with the present disclosure, a printer specifically developed to be used with disappearing inks may optionally incorporate specific features targeted to such use. For example, these features may include, without limitation:

- a sensor to detect if the reusable substrate or output media is ready for reprint or use, in particular, if ink or printed matter is detected (e.g., from a previous job) the device may optionally reject the paper or media;

a means to apply a cover sheet on top of the printed surface to block or prevent the ink from evaporating/sublimating;

a means to remove a cover sheet before printing to allow ink to evaporate/sublimate immediately before feeding the substrate to print thereon;

a means to blot off extra ink off the substrate;

a means to adjust the amount of ink deposited based upon indicia size to compensate for disappearing times which vary in response to deposited ink volume; and a sensor and/or means to detect if the reusable paper or media is fed with the correct (i.e., the porous or opacity switching) surface up or facing the print-head.

Further in accordance with the present disclosure, a disappearing ink formulation provides a liquid mixture of water, alcohols (methanol, ethanol, propanol, etc.), OH and/or NH containing liquid materials (in a liquid state at room temperature) such as glycols and glycerin. Volatile siloxanes and esters can also be used in the ink formulations. The ink formulation can further contain pigments and other solids which may or may not evaporate substantially completely with the liquid portion of the ink. For ink formulations that do not completely evaporate or sublimate, other methods of erasing the ink may also be employed, including inter alia washing, and dissolving in solution.

Generally speaking, one embodiment of a disappearing ink formulation in accordance with the present disclosure evinces good surface tension and sufficient viscosity to permit deposition via inkjet and/or like methods. One particular embodiment is a formulation including a first liquid with a relatively higher boiling point and another second liquid with a relatively lower boiling point than the first liquid. By varying the ratio of the two liquids, the disappearing time for the formulation also can be varied, because the liquid with the lower boiling point will evaporate or sublimate more rapidly than the liquid with the higher boiling point. One example of a suitable higher boiling point liquid is glycerin, and examples of a suitable lower boiling point liquid include water, methanol, ethanol, and any combination thereof.

Image or printing contrast also can be varied by varying the ink formulation. For example, lowering the percentage of glycerin in the ink lowers the printed contrast because fewer pores in the opacity switching over-layer are able to absorb the ink.

Particular embodiments for specific ink formulations in accordance with the present disclosure as listed in the below table.

| | Materials | % | Amount (g) |
|---|---|---|---|
| Formula-1 | Glycerin | 50 | 200.0 |
| | DI H20 | 50 | 200.0 |
| Formula-2 | Glycerin | 40 | 160.0 |
| | DI H20 | 60 | 240.0 |
| | SURFANOL 104 | 0.1 | 0.4 |
| Formula-3 | Glycerin | 50 | 200.0 |
| | DI H20 | 50 | 200.0 |
| | SURFANOL 104 | 0.1 | 0.4 |
| Formula-4 | Glycerin | 50 | 200.0 |
| | Methanol | 50 | 200.0 |
| | SURFANOL 104 | 0.1 | 0.4 |
| Formula-5 | Glycerin | 70 | 280.0 |
| | Methanol | 30 | 120.0 |
| | SURFANOL 104 | 0.1 | 0.4 |
| Formula-6 | Glycerin | 50 | 200.0 |
| | Ethanol | 50 | 200.0 |
| | SURFANOL 104 | 0.1 | 0.4 |
| Formula-7 | Glycerin | 40 | 160.0 |
| | Ethanol | 60 | 240.0 |

-continued

| | Materials | % | Amount (g) |
|---|---|---|---|
| | SURFANOL 104 | 0.1 | 0.4 |
| Formula-8 | Glycerin | 50 | 200.0 |
| | Ethanol | 35 | 140.0 |
| | DI H20 | 15 | 60.0 |
| | SURFANOL 104 | 0.1 | 0.4 |
| Formula-9 | Glycerin | 50 | 200 |
| | Ethanol | 25 | 100 |
| | DI H20 | 15 | 60 |
| | Methanol | 10 | 40 |
| | SURFANOL 104 | 0.1 | 0.4 |
| Formula-10 | Glycerin | 50 | 200.0 |
| | Ethanol | 35 | 140.0 |
| | DI H2O | 15 | 60.0 |

Formula-10 is similar to Formula-8 but does not incorporate a surfactant. Notably, including a surfactant in the ink has been observed to increase bleeding of the deposited ink, and thus can reduce the sharpness of the printing.

In a further embodiment in accordance with the present disclosure, a disappearing ink is formulated to evince a relatively high boiling point (e.g., sufficiently high that evaporation or sublimation will not occur at or around room temperature). However, the aforementioned ink (e.g., upon the application of energy thereto) is formulated to be fragmented into a plurality of components that have relatively low boiling points (e.g., low enough to evaporate or sublimate at room temperature). In use, such an ink would exhibit essentially infinite or otherwise significantly long persistence once deposited onto a surface (i.e., it would be essentially permanent at room temperature), but upon absorption of energy the ink would fragment into two or more components that each evince a sufficiently low boiling point so as to evaporate or sublimate at or near room temperature, preferably within a short period of time. Suitably, the aforementioned energy is optionally applied in any practicable manner, including but not limited to applying ultraviolet (UV) radiation, infrared (IR) radiation, near-infrared radiation, corona treatment, and microwave radiation. Optionally, the ink can also be formulated to evince a color.

In another embodiment, energy is applied to induce a change in the hydrophilic properties of the printing substrate or media so that upon application of energy the printing substrate becomes sufficiently hydrophobic to evict deposited ink therefrom. In one non-limiting exemplary embodiment, low boiling point compounds may be covalently immobilized onto the printing substrate and, upon the application of energy, could change the hydrophilicity evinced by the substrate so as to render the substrate hydrophobic and allow ink deposited thereon to be quickly and/or easily removable from the substrate or to simply evaporate or sublimate therefrom, preferably at or near room temperature.

In one specific, non-limiting, illustrative example, an ink formulation is optionally prepared based on t-butoxy carbonyl chemistry (t-BOC) that evinces fragmentation induced by acids produced in-situ by the application of UV or IR radiation. Such an approach may be useful in removing the ink from the media by fragmenting the initial high boiling ink into several more volatile (low boiling) species. One such possible ink formulation is given by Formula (1) below, where R may be an analog of a glycerol type and PAG refers to a photochemical acid generator. Alternatively and in reference to the embodiment described in the immediately preceding paragraph, R could be the printing substrate, e.g., the opaque porous layer (SiO2, ZnO, etc.)

Formula (1)

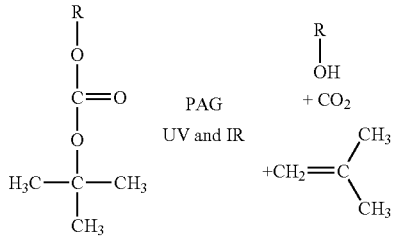

PAG compounds usually take the form of iodonium (R2I+X−) or sulfonium (R3S+X−) salts. These compounds decompose upon light exposure to provide a complicated mixture of products, chief among which is the acid HX. This acid then catalyzes the de-protection or fragmentation of acid sensitive groups such as t-BOC groups.

In another specific, non-limiting, illustrative example, an ink formulation is optionally prepared based on diazonapthaquinone chemistry as exemplified by Formula (2) below, wherein the compound undergoes photochemical Wolf rearrangement in presence of UV radiation and moisture to produce a carboxylate group that renders the compound hydrophilic and changes the pH of the formulation. Such an approach can potentially be used to control the wetting/dewetting of the printing substrate by the ink. Examples of liquids that will split under heat include bicyclo[2.2.1]hept-2-ene, 5-norbornene-2-methanol, 5-norbornene-2-endo, 3-endo dimethanol, 5-norbornene-2-carbonitrile, and 5-norbornene-2-carboxylic acid.

Formula (2)

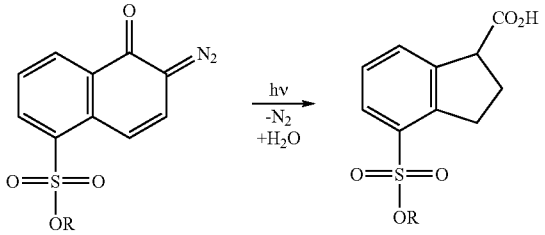

In accordance with other embodiments of the present disclosure, a substrate or media suitable for printing with disappearing inks as disclosed herein can be formed as generally known in the art by applying an opaque layer that becomes translucent when wet (i.e., referred to herein nominally as the top or porous or opaque layer) onto an underlying colored layer. As can be appreciated, while referred to at times herein as an opaque layer, this layer turns or becomes sufficiently translucent or transparent (e.g., in response to the presence of ink residing thereon and/or absorbed therein) to reveal the underlying layer. Suitably, the opaque layer is porous and ink deposited onto it is absorbed into the pores, thereby rendering the top layer translucent and revealing the colored underlying layer. One approach to improving the performance of such substrates is in preparing a top or opaque layer with small pores, to thereby improve printing resolution.

In another embodiment, a substrate or media suitable for printing with disappearing inks as disclosed herein can be formed by disposing an opaque porous layer that becomes translucent when wet between a colored porous layer and a non-porous carrier layer, e.g., which is sufficiently translucent or transparent. In use, the disappearing ink is selectively deposited onto the porous colored layer. The ink is accordingly absorbed through the porous colored layer and into the otherwise opaque layer, thereby turning the opaque layer sufficiently translucent or transparent so that the porous colored layer can be viewed therethrough from the other side in the regions where the ink was deposited. Next, the entire substrate sheet can be folded over so that the porous colored layer is folded onto itself and the non-porous transparent layer remains exposed on both sides of the substrate sheet. In essence the non-porous transparent layer substantially envelops the other two layers therein forming the outer layer of both major surfaces, thereby suppressing or significantly retarding the evaporation or sublimation of the ink, which will have been absorbed through the colored layer into the opaque layer. The folding action further gives the entire substrate sheet the appearance of having been printed on both sides.

In a further embodiment, a substrate suitable for printing with disappearing inks as disclosed herein can be formed with an opaque layer that becomes translucent when wet over an underlying white layer. Disappearing inks including colored ingredients (e.g. chlorophyll) could be deposited on such substrates to thereby create colored printed matter.

FIG. 1 shows an exemplary construction 100 of an erasable and/or reusable media suitable for use in conjunction with disappearing inks as disclosed herein. As shown, the construction includes a porous opacity changing top layer 110 over a colored layer substrate 120, and an optional clear primer or tie layer 130 disposed therebetween. In accordance with the present disclosure, a preferred opacity changing porous layer is formed of filler particles entrained or suspended in a binder resin. The filler particles are optionally organic or inorganic, and preferably have little or no inner crystallinity because microcrystalline structures inside the particles can affect the transparency evinced by the layer when wetted by liquid ink. For inorganic particles such as silica and alumina, a suitable form is amorphous silica/alumina. Examples of inorganic particles that are optionally used include silica (SiO2), zinc oxide, alumina, clay, talc, kaolin, CaCO3, barite, silicate, and glass beads. Organic particles of various sizes are also commercially available, such as polyvinyl chloride (PVC), acrylic, urethane, styrene powders and copolymer powders. The porosity evinced by the opacity changing porous layer may be due to interstitial spaces between the filler particles entrained in the binder and optionally to the use of porous filler particles.

A preferred embodiment uses amorphous silica particles, which have a refractive index of about 1.4 that is similar to that of most polymer resins and also certain disappearing ink formulations that include glycerin, propylene glycol, ethanol, methanol, siloxanes, esters, and water. Due to the inkjet receptive coating industrial demands, silica particles of different kinds (size, porous or non-porous) are commercially available. Major vendors of silica include: Cabot of Alpharetta, Ga. (Cabosil product line), Degussa of Germany, Grace Davison of Columbia, Md. (Sylojet product line), Energy Strategy Associates Inc. of Old Chatham, N.Y. (NAN-O-SIL product line), Nissan Chemical of Japan (Snowtex product line), Ineos of the United Kingdom (Gasil product line), and International Specialty Products of Wayne, N.J. (Silcron product line). Either precipitated or fumed silica powders are suitable because both create silica with many OH functional groups for better ink absorption and binding with hydrophilic resin systems.

An important consideration in forming the opacity changing porous layer is the size of the silica. Experiments have indicated that the optimal size can range from sub-micron up to about 2 microns. After coating the particles of silica with a minimum amount of binder, a porous layer is formed. The porous layer can include relatively large pores due to aggregation or agglomeration of the silica particles, and relatively small pores inside each particle or aggregate. Generally, the larger pores have the most impact on the performance of the opacity changing layer. Experiments indicate that an optimal size for the large pores is preferably in the range of submicron to about 2 microns. In one preferred embodiment, NAN-O-SIL with a particle size from about 20 nm to about 500 nm is used. The opacity changing porous layer may be formed to offer a specific surface tension (dyne level) that may be specifically matched to the properties of a disappearing ink formulation, with the suitable selection of the binder (s) and the porous particles in terms of porosity and hydrophobicity.

The binder resin is optionally any polymeric resin. For example, suitable water-based resins include polyvinyl alcohol (PVOH), starches, starch derivatives, ethylene vinyl alcohol (EVOH), ethylene vinyl acetate (EVA), urethanes, and acrylics. The binder resin solid should be controlled to be in low ratio relative to the filler particles so that after coating and drying, a porous structure is formed (the filler particle amount can be significantly above the critical particle volume concentration). Therefore, curing of the binder resin is suitably done so as to impart sufficient mechanical strength to the opacity changing porous layer, and as such the curing is optionally thermal curing or ultraviolet (UV) curing. For thermal curing polyaziridine or melamine formaldehyde is optionally used. Particular suitable crosslinkers that are optionally used are Kymene and Polycup from Hercules Inc. of Wilmington, Del.

The underlying colored layer is optionally any resin system colored by, for example, carbon black. Experiments indicate that coating a white porous top layer directly onto black paper (black paper is also quite porous) results in reduced bleeding of the deposited ink in instances when more ink is deposited than can be absorbed by the top layer. In such circumstances, the underlying paper can absorb the excess ink and thereby reduce bleeding. However, ink soaking into the underlying paper layer from the top layer also tends to result in reduced printing contrast. Therefore, in a further embodiment in accordance with the present disclosure and also shown in FIG. 1, a clear primer layer (or tie layer) 130 is disposed between the paper or colored layer 120 and the opaque, porous layer 110 to stop ink migration into the paper and thus enhance printing contrast.

One particular embodiment for an underlying colored layer is listed in the below table.

| | % Solid | Amount | Solid contained |
|---|---|---|---|
| Hycar 26706 | 50.00% | 25.000 | 12.500 |
| Byk 024 | 100.00% | 0.050 | 0.050 |
| Black Mill Base (Cabot CAB-O-Jet 200 Black) | 20.44% | 16.000 | 3.270 |
| Cellosize ER15 | 2.00% | 4.000 | 0.080 |
| Totals | | 45.050 | 15.900 |
| | | % Solids | 35.30 |

Three particular embodiments for formulations for silica mill base incorporating NAN-O-SIL, for use in preparing opacity changing porous layers, are listed in the below tables.

NAN-O-SIL 080422-1

| | % Solid | Amount | Solid contained |
|---|---|---|---|
| Water | 0.00% | 100.000 | 0.000 |
| IPA | 0.00% | 20.000 | 0.000 |
| Solsperse 27000 | 100.00% | 0.500 | 0.500 |
| BYK 024 | 100.00% | 0.250 | 0.250 |
| Surfanol 104 | 100.00% | 0.500 | 0.500 |
| Cellosize ER15 | 2.00% | 4.000 | 0.080 |
| NAN-O-SIL | 100.00% | 20.000 | 20.000 |
| Totals | | 145.250 | 21.330 |
| | | % Solids | 14.69 |

NAN-O-SIL 080429-1

| | % Solid | Amount | Solid contained |
|---|---|---|---|
| Water | 0.00% | 130.000 | 0.000 |
| IPA | 0.00% | 20.000 | 0.000 |
| Solsperse 27000 | 100.00% | 0.500 | 0.500 |
| BYK 024 | 100.00% | 0.100 | 0.100 |
| Sulfynol 104 | 100.00% | 0.250 | 0.250 |
| NAN-O-SIL | 100.00% | 40.000 | 40.000 |
| Cellosize ER15 | 2.00% | 3.000 | 0.060 |
| Totals | | 193.850 | 40.910 |
| | | % Solids | 21.10 |

NAN-O-SIL 080516-1

| | % Solid | Amount | Solid contained |
|---|---|---|---|
| Water | 0.00% | 250.000 | 0.000 |
| Solsperse 40000 | 84.00% | 3.680 | 3.091 |
| BYK 024 | 100.00% | 0.150 | 0.150 |
| NAN-O-SIL | 100.00% | 76.000 | 76.000 |
| Totals | | 329.830 | 76.000 |
| | | % Solids | 24.02 |

One particular embodiment for a formulation for an opacity changing porous layer is listed in the below table.

| | % Solid | Amount | Solid contained |
|---|---|---|---|
| Lubrizol Turboset 2025 | 36.00% | 3.500 | 1.260 |
| NAN-O-SIL 080422-1 | 14.69% | 16.000 | 2.350 |
| Cellosize 2% in H2O | 2.00% | 3.000 | 0.060 |
| Surfanol 104 | 100.00% | 0.080 | 0.080 |
| Totals | | 22.580 | 3.750 |
| | | % Solids | 16.61 |

Another particular embodiment for a formulation for an opacity changing porous layer is listed in the below table.

| | % Solid | Amount | Solid contained |
|---|---|---|---|
| Lubrizol Turboset 2025 | 36.00% | 2.500 | 0.900 |
| GE Silicone CRA SM3030 | 40.00% | 2.500 | 1.000 |
| GE Silicone Platinum Catalyst SM3010 | 40.00% | 0.250 | 0.100 |
| NAN-O-SIL 080516-1 | 24.00% | 24.000 | 5.760 |

-continued

| | % Solid | Amount | Solid contained |
|---|---|---|---|
| Methocel (10% in H2O) | 10.00% | 0.000 | 0.000 |
| Totals | | 29.250 | 7.760 |
| | | % Solids | 26.53 |

Suitably, the above coating is optionally deposited with a roughly 80 μm spreader bar, then cured and dried at about 100° C. for about 5 minutes, to obtain a coat weight of about 13.83 g/m2.

One particular embodiment for a formulation for a primer coating (tie coat) that can be disposed between a colored layer (paper) and an opacity changing porous layer is listed in the below table.

| | % Solid | Amount | Solid contained |
|---|---|---|---|
| Lubrizol Turboset 2025 | 36.00% | 8.000 | 2.880 |
| NAN-O-SIL 080422-1 | 14.69% | 16.000 | 2.350 |
| Cellosize 2% in H2O | 2.00% | 2.000 | 0.040 |
| Surfanol 104 | 100.00% | 0.080 | 0.080 |
| Totals | | 26.080 | 5.350 |
| | | % Solids | 20.52 |

In accordance with another embodiment of the present disclosure, a substrate suitable for printing upon with disappearing inks as disclosed herein as well as those known in the art is prepared by immobilizing hydrophilic particles (which provide the "pores" in the layer) in a binder, the particles are selected such that they are opaque when dry and become transparent or translucent when they absorb a liquid. Suitable materials for the hydrophilic particles include silica and alumina powders, alumino-silicates, organic polymers, colloidal silicas, aluminum oxides dopes with ions, and various porous polymers as known in the art, and may be in the range of about 100 nm to about 1 μm. To enhance the printing resolution, a minimal amount of binder is optionally used, and therefore the binder will optionally have relatively high strength and be crosslinked. Suitable hydrophilic binders include poly vinyl acetate (PVA), cellulose, starches, polyvinyl pyrrolidone, chitosan, gelatins, polyethylene oxide, and poly(2-ethyl-2-oxazoline) (PEOX). In one suitable embodiment, the binder is hydrophobic to thereby prevent bleeding of ink between adjacent pores or particles, examples of which include styrene butyl acrylate (Sty-BA) copolymers, acrylic polymers, EVA, vinyl acetate (VA), and polyurethane (PU).

In further embodiments contemplated herein, a colored layer (paper) for disposing beneath an opacity changing layer optionally includes security features such as watermarks, and may also optionally include radio frequency identification (RFID) devices attached to it or embedded within. The colored layer may also optionally be formed with a metallic and/or reflective surface disposed underneath the opacity changing layer. Either or both of the colored layer and the opacity changing layer can be formed of or with biodegradable materials.

Figure 2:
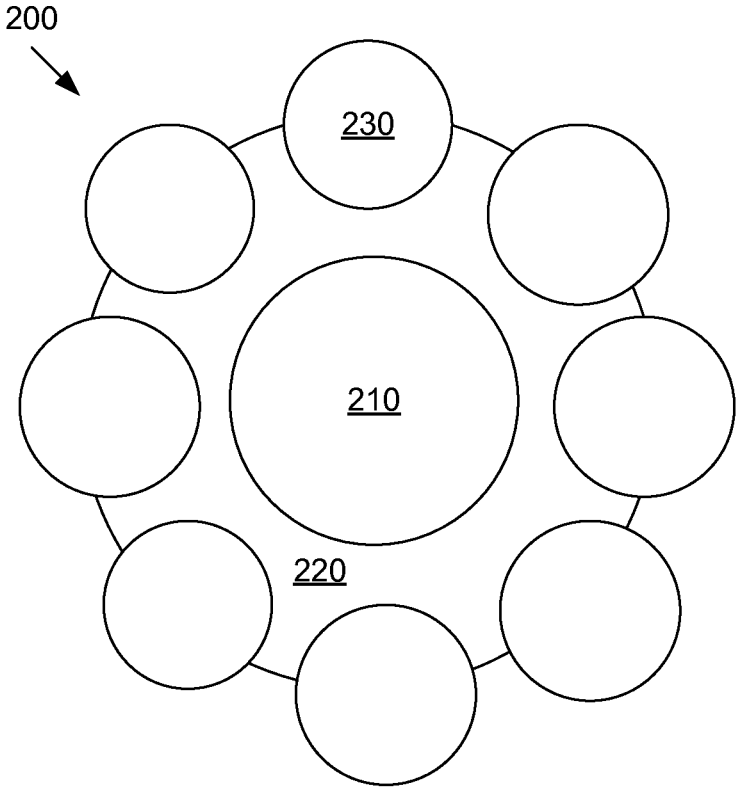
FIG. 2 is a schematic depiction of a porous particle for preparing a substrate for printing upon in accordance with the present disclosure.
Figure 3:
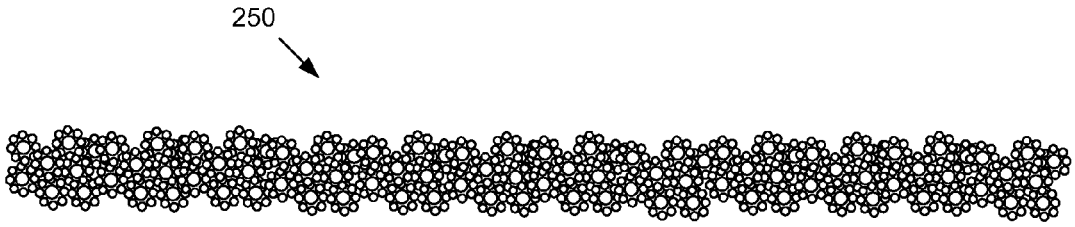
FIG. 3 is a side view in exaggerated scale of a substrate prepared with the porous particles of FIG. 2 in accordance with the present disclosure.

In a further embodiment in accordance with the present disclosure, and with reference to FIG. 2, a substrate for printing upon with disappearing inks is formed of a plurality of structures 200 bound to each other in a sheet-like layer. Each structure 200 includes a colored (that is, not transparent) particle or particles 210 (e.g. pigment) encapsulated by a binder 220 within which hydrophilic particles 230 are entrained. Suitable binders 220 and hydrophilic particles 230 are described hereinabove. When a liquid is absorbed by the hydrophilic particles 230, the colored particles 210 are revealed by the hydrophilic particles becoming transparent or translucent, thereby creating the appearance of printed matter. In essence, the colored particles 210 replace the underlying colored layer of the previous embodiment, and therefore the present embodiment provides a printing substrate that consists of a single layer 250, composed of structures 200 bound together, e.g., as shown in exaggerated scale in FIG. 3. As such, the substrate of the present embodiment may be printed upon both surfaces thereof.

In a further embodiment, disappearing inks as disclosed herein could be used to print with different colors by providing a printable substrate with an underlying colored layer formed with pixels of different colors grouped in regular intervals, similar to the tri-color pixels of a color monitor or display or television. For example, each pixel or pixel group optionally includes a set of colored elements defining a selected color space—such as RGB (red, green, blue) or CYMK (cyan, yellow, magenta, black). Optionally, the printer or device as described herein detects the relative or other spatial orientation of the different colored pixel elements, e.g., such as by printing a small test patch onto each sheet and sensing the underlying colors. Accordingly, to print a multi-color document, the printer or other like device then deposits the disappearing ink onto each specific pixel location so as to form or otherwise unveil a specific colored pixel element thereat and thereby render an overall colored image. Thus, in one particular exemplary embodiment, structures 200 could be provided with different-colored particles 210 and disposed in an RGB or CYMK color space pattern to be selectively wetted/printed upon by such a specialized printer or other like device.

A further enhancement to the substrate constructions disclosed herein optionally include forming the porous layer with reduced porosity to thereby minimize the bleeding of ink through interconnected pores. There are numerous methods to accomplish this, all of which are contemplated by the present disclosure. One non-limiting example involves the blending of hydrophobic particles together with the porous particles to form the opacity changing layer. The hydrophobic particles would be evenly dispersed through the opacity changing layer and limit the overall porosity of the layer material. Another approach entails the blending of thermoplastic particles together with the porous particles to form the opacity changing layer. Suitably, the thermoplastic particles would be evenly dispersed through the opacity changing layer and the layer would be heated so as to melt the thermoplastic particle, which would thereby seal or encapsulate some of the porous particles and thus limit the overall porosity of the layer material.

One method of forming the substrate of the present embodiment entails dispersing the pigment particles 210 and the binder 220 in a liquid that is immiscible with the binder, mixing, and then curing the mixture into a sheet configuration. Next, the hydrophilic particles 230 are grafted (either chemically or with a further binder) onto the sheet. An advantage of the grafting process is that it will prevent the formation of multiple layers of hydrophilic particles onto the pigment particles, which could adversely affect the transparency evinced by the substrate when wetted by ink. Two specific formulations for a substrate according to the present embodiment are listed below.

| %-wt | Ingredient |
|---|---|
| | Formulation 1 |
| 6.560 | PP2-01 functionalized pp emulsion |
| 2.656 | Methocel E15 LV |
| 33.196 | MIN-USI1 5-5 um silica |
| 0.133 | Byk 420 |
| 2.656 | Tergitol 15-S-40 diluted to 20% |
| 0.664 | IPA |
| 1.022 | Kymene 624 20% sol. |
| 53.114 | Water |
| | Formulation 2 |
| 3.159 | Methocel E15 LV |
| 15.793 | Nan-o-sil 5 to 500 nm |
| 0.190 | Byk 420 |
| 31.586 | IPA |
| 0.632 | Kymene 624 20% sol. |
| 47.378 | Water |

The uses for the embodiments described herein and their equivalents are many. In particular, any matter than one desires to be printed but only for a limited period of time can be achieved with these embodiments. For instance, newsletters or other periodicals (e.g. newspapers, magazines, etc.) could be downloaded via the Internet and printed by an individual reader in a temporary manner as disclosed herein, on a continuous basis, repeatedly using the same sheet or sheets with disappearing ink as described herein. In this manner, the environmental impact of the printing is reduced to almost zero because the ink evaporates or sublimates rather than leach into the ground as with discarded printed matter, and the "paper" is recycled over and over again. The user could thus read each days' newspaper in the morning, where it may have been automatically downloaded overnight and printed, and then reload the sheets into the printer, where the ink would eventually disappear and the sheet would thus become ready to be printed upon again. By the embodiments disclosed above, a user can select various disappearing times for various jobs, and thus could choose a daily newspaper to have a short disappearing time and a longer one for a more voluminous, weekly or monthly publication. A user could print other matter as well, for instance temporary signs such as "For Sale" signs. Temporary ID cards could also be issued in this manner, such as visitor badges, airport boarding passes, etc. Schools could print all sorts of materials with the embodiments disclosed herein, such as short term handouts and examination sheets, which optionally can have certain information printed permanently and other information with disappearing ink. In a still further embodiment, students could be given pens filled with disappearing ink to temporarily mark or write out their answers on such examination sheets.

In yet further embodiments in accordance with the present disclosure, an opacity changing layer as described elsewhere herein may be formed over the surface of a functional and/or structural object so that upon being wetted, it may reveal the color of the underlying object. Non-limiting examples of such embodiments include bathroom tiles that can change color when they are wet (either as a safety warning or for decorative effect), the inner capillary of a thermometer that can change color as a liquid held within rises along the capillary to thereby indicate temperature, and artificial grass blades than can be deployed in a lawn and that can change color from green to brown or other non-green color as liquid from the opacity changing over-layer evaporates to indicate that the lawn needs watering.

Figure 5:
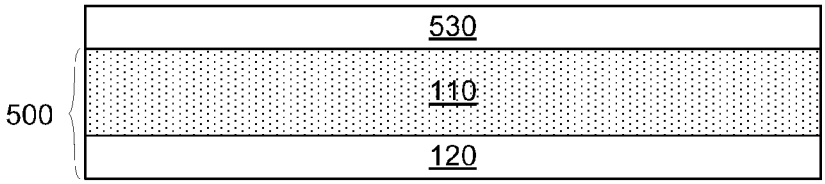
FIG. 5 is a side view of a substrate for printing upon in accordance with the method of FIG. 4.
Figure 4:
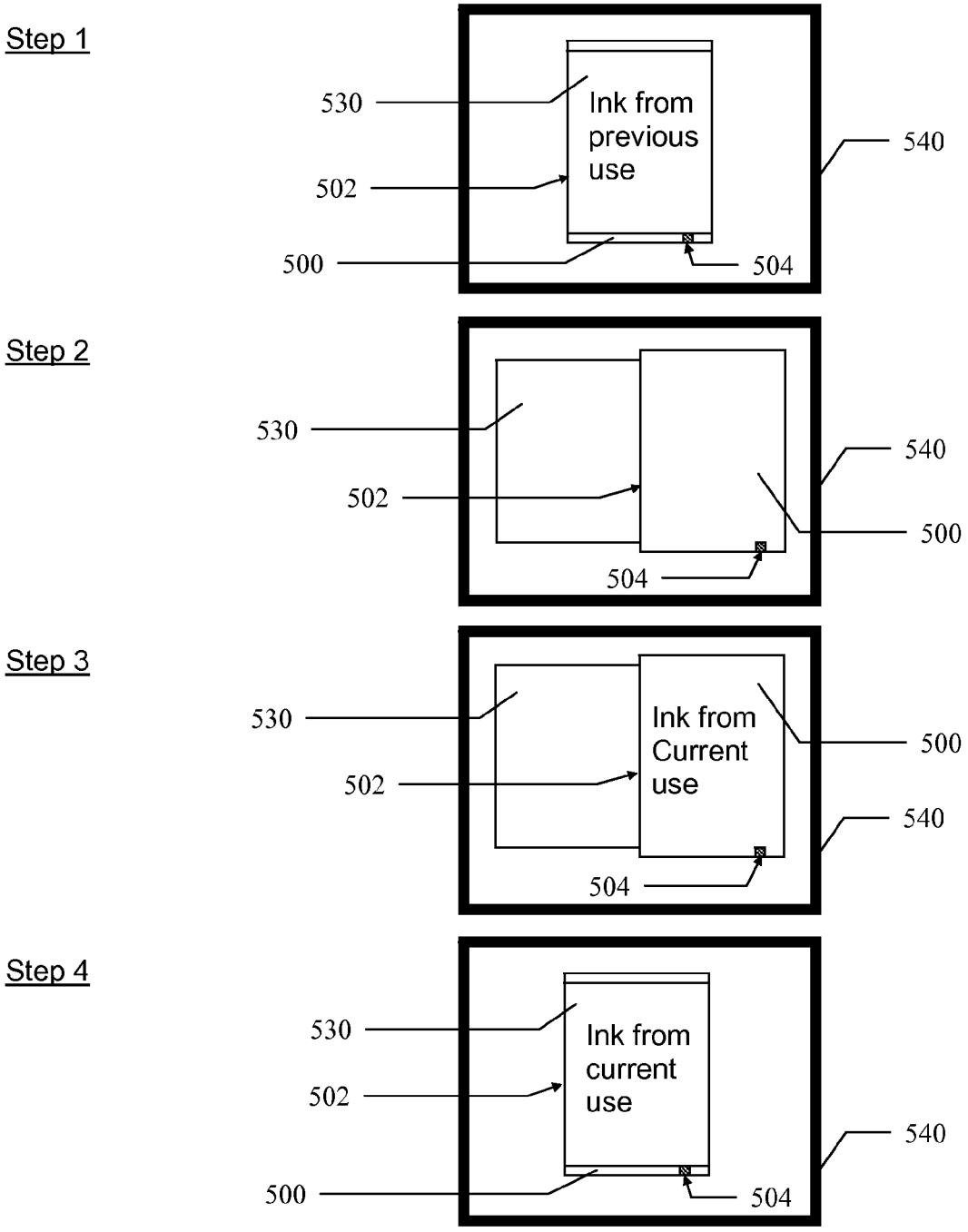
FIG. 4 is a flowchart depicting a method for slowing or halting the evaporation of deposited disappearing ink in accordance with the present disclosure.

Alternatively, in accordance with another embodiment according to the present disclosure and with reference to FIGS. 4 and 5, the evaporation of disappearing ink could be halted or substantially slowed by applying a substantially transparent, removable, barrier layer 530 onto the printed sheet 500, thereby retarding the disappearance of the ink until a desired time at which moment the barrier layer can be removed, thereby allowing the ink to evaporate or sublimate at its normal rate. Such a barrier layer may be formed with a selected porosity to evince a controlled evaporation rate for any underlying liquid, and barrier layers having various print retention times as dictated by their porosity could be provided to consumers to enable selection of a most desired print retention time. Optionally, the barrier layer can be water-resistant. Through the use of such barrier layers matter printed in accordance with the present disclosure can be rendered semi-permanent, that is, until the user decides to re-use the printed sheet. Such a barrier layer could be applied in solid form or sprayed on in liquid form. The barrier layer could also be provided as a removable backing to the printable sheet, and alternatively can be formed as a sleeve to receive the printable sheet therein. The barrier layer could further provide a surface onto which a user could write with erasable ink such as dry erasable markers. The barrier layer can be attached to the printable sheets by any means practicable, including adhesives, static adhesion, and cohesive adhesion, and can further include permanent attachment means such as at the edges to allow a user to render the printed matter permanent. The barrier layer also can include means to allow air to be removed from between it and a printed sheet it is attached to. The barrier layer also can be formed of or with biodegradable materials.

With reference now to FIG. 4, the barrier layer 530 can be provided assembled contiguously with the printable sheet 500, such as by being attached to the printable sheet 500 along one side 502 thereof along which the user or a specialized printer (illustrated diagrammatically by reference numeral 540) can fold the assembly to adhere the printed sheet and barrier layer to one another (e.g., as shown in the step 1 configuration). Such an assembly could then be "opened up" (e.g., as shown in the step 2 configuration) by disengaging the barrier layer from the surface of the printed sheet, the disappearing ink allowed to or optionally forced to evaporate or sublimate, and the entire assembly of printable sheet and barrier layer inserted into a printer to be reprinted upon. Optionally, the assembly can include one or more markings (e.g., such as marking 504) that allow a printer to detect whether the assembly has been inserted into the printer in the proper orientation. Alternatively, the entire process of attaching and detaching the barrier layer from the printable sheet can be performed within the printer, such that the user only handles the assembly in the attached configuration, and the printer detaches the barrier from the printable sheet before printing thereupon, optionally wipes the barrier clean and/or aids in the evaporation of the disappearing ink, prints onto the printable sheet, reattaches the barrier onto the printed sheet, and ejects the entire assembly for the user. Optionally, the printer can receive the assembly in the detached configuration and eject it in an attached configuration, or it can receive the assembly in attached configuration and eject it in detached configuration for the user to attach. In a still further embodiment, the printer could deposit the ink onto the barrier layer instead of the printable sheet, then attach the two such that the ink is absorbed into the opacity changing layer of the printable sheet. In other embodiments, additional coatings or layers can be provided, such as to promote adhesion of a barrier layer and/or to provide security features such as for example watermarks.

In accordance with one exemplary embodiment, FIG. 4 shows a multi-step process in which steps 1-4 are carried out in order by a suitable printer or other like device. Of course in other suitable embodiments and/or selected applications, it is to be appreciated that additional steps may be included, some of the illustrated steps may be omitted, and/or the order of steps may be altered, depending on the circumstances of a given embodiment and/or application.

In any event, as illustrated in FIG. 4, at step 1, a user places the previously used media assembly, i.e., including the writable media or printable sheet 500 (e.g., such as described herein and/or otherwise compatible and/or designed for use with disappearing inks) and the barrier layer 530 (e.g., a plastic cover sheet), in a suitable printer or other like device equipped with one or more disappearing inks and/or otherwise provisioned for marking and/or manipulating such media assemblies. As shown in step 1, suitably the media assembly is configured with the barrier layer 530 engaging the major surface of the printable media sheet 500, thereby barring or retarding evaporation and/or sublimation of the disappearing ink therefrom. As shown, the media assembly includes an optional registration or other like mark 504 which can be detected by an electronic eye or other like sensor to determine the orientation of the media assembly. If the orientation of the media assembly within the printer or other like device is determined to be wrong, optionally the media assembly is manipulated (e.g., flipped, shuffled and/or rotated) to achieve a proper orientation.

At step 2, the media assembly is opened by the printer or other like device, i.e., the barrier layer 530 is disengaged from the major surface of the printable sheet 500. Accordingly, the ink from the previous use is allowed to evaporate and/or sublimate off the printable sheet 500 thereby preparing it for further use. Suitably, to ensure sufficiently rapid execution of this step, disappearing inks with quick evaporation and/or sublimation properties (i.e., non-water based disappearing inks) are advantageously employed. Optionally, heating, irradiation and/or other like applications of energy or suitable drying techniques are employed to further hasten the evaporation and/or sublimation processes.

At step 3, the now "erased" media assembly is forwarded to the marking engine or imaging station of the printer or other like device where one or more disappearing inks are deposited on the printable sheet 500 in accordance with the current job. Suitably, in one embodiment, the assembly is fed with the barrier layer 530 trailing the printable sheet 500.

Finally, at step 4, the barrier layer 530 is re-engaged with the major surface of the printable sheet 500, e.g., by folding the barrier layer 530 over the top of the printable sheet 500. As described earlier herein, the barrier layer 530 may be engaged or adhered to the surface of the printable sheet 500 by a variety of suitable means, e.g., such as cohesive adhesion, static cling, etc.

In an alternative embodiment contemplated by the present disclosure and with continued reference to FIG. 5, a substrate 500 can be prepared as disclosed herein to include an opacity changing layer 110 on a substrate layer 120, wherein the substrate layer is substantially clear. Upon printing onto the opacity changing layer with disappearing ink, a barrier layer 530 that is colored is applied onto the surface of the opacity changing layer so that a viewer looking at the carrier will see the printed matter as evinced by the colored barrier layer exposed through the opacity changing layer by the ink deposited thereupon. As can be appreciated, this embodiment generally demands that the printer essentially print a mirror copy of the text and graphics because it would in fact be printing from the backside or underside of the paper rather than the top side as per conventional printers currently known in the art.

In a still further alternative embodiment, the present teachings can be employed in a reverse printing method whereby a substrate can be prepared as disclosed herein to include an opacity changing layer on a substrate layer, the opacity changing layer covered entirely with disappearing ink, and a barrier layer deposited thereupon to arrest the evaporation or sublimation of the ink. In use, such a substrate is inserted into a specialized printer that removes the barrier layer, then selectively removes ink from the opacity changing layer to thereby create the printed matter. Removal of the ink can be by any means practicable, include the application of heat, vacuum, or dissolving agents. To reuse the substrate, the cover sheet is removed and disappearing ink reapplied to the entire opacity changing layer; this function may be accomplished by the printer. This embodiment is therefore a reverse printing method in that the background of the printed sheet is covered by disappearing ink and the printed matter is evinced by the absence of ink.

In further uses of the embodiments described herein, books can be printed temporarily. For example, users could be provided with kits including a printer, printing substrates/paper and binding means to enable the users to print books on the reusable paper then cover them with protective sheets and optionally bind into a book. Once the user has finished reading the book, the pages can be unbound and reused to print another book. The binding and unbinding can alternatively be a function performed by the printer at the user's discretion. Further functions provided by the printer can include applying a barrier layer onto a printed sheet, sealing the barrier layer, and erasing markings on the barrier layer such as by differential wetting with a second liquid (separate and different from the disappearing inks) or a wiper roller.

In other embodiments according to the present disclosure, the evaporation of disappearing ink could be accelerated such as by the application of heat (including infra-red, near infra-red, radio frequency (RF) and microwaves), or a dissolving agent such as air or water. Such means for accelerating the disappearance of the ink could be provided within a printer, such as for instance a feed-in slot into which a user could insert a temporarily printed sheet, which would then be processed to remove the ink therefrom by any of the means mentioned. Such an erasing mechanism may be provided as a component of a specialized printer, or alternatively may be provided as a separate component configured to be attached to existing printers. Such an add-on component could be configured, for example, as a sheet feeding tray to thereby hold and feed the sheets to the printer and erase any disappearing ink therefrom prior to feeding them to the printing mechanism of the printer to be printed thereupon.

To further accelerate evaporation, the ink may be formulated with additional components that are preferential energy absorbers, that is, absorb energy at specified wavelengths with particularly high efficiency. A printer could be provided with an energy emitter that emits radiant energy at the specified wavelengths (infra-red, visible, microwave, etc.), thereby heating the ink much more rapidly than then underlying substrate and accelerating the evaporation of the ink therefrom. In a further embodiment, disappearing inks containing such preferential energy absorbers could be formulated to have very long natural evaporation times, so that matter printed with such inks would be practically permanent, and the ink would be removed quickly within the printer just prior to new matter being re-printed onto the same substrate by the application of energy at the appropriate wavelengths for evaporating the ink. Given the relatively small amount of ink deposited, limited amounts of focused energy would likely be suitable to render the substrate clean and ready for subsequent re-printing. In one particular embodiment, the particle 210 of the embodiment of FIG. 2 could be formed with or include the preferential energy absorber.

An alternative embodiment of a printer as disclosed herein is further provided with printing means that deposit ink in one simultaneous line across substantially the entire width of the printing media, to thereby accelerate the printing process. Such printing means can include a plurality of jets or print heads disposed across the width of the printer media interface and being fed with ink from one or more reservoirs simultaneously.

The substrates provided herein could also be printed upon with permanent ink, which would permanently fill the porous structure of the opacity changing layer and thereby render the printed portion non-printable with disappearing ink.

Having now described the invention in accordance with the mandates of the patent statutes, those skilled in this art will understand how to make changes and modifications to the present inventive subject matter to meet their specific circumstances or conditions. Such changes and modifications may be made without departing from the scope and spirit of the invention as disclosed herein.

The embodiments described herein are presented for purposes of illustration and disclosure in accordance with the mandates of the law. It is not intended to be exhaustive nor to limit the invention to the precise form(s) described, but only to enable others skilled in the art to understand how the inventive subject matter may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . "

What is claimed is:

1. A method for providing disappearing inks, said method comprising:

selecting a first ink comprising a first formulation of ingredients prepared to cause the first ink, upon deposition onto an ink receiving media, to disappear therefrom at a first rate; and selecting a second ink comprising a second formulation of ingredients prepared to cause the second ink, upon deposition onto the ink receiving media, to disappear therefrom at a second rate which is different than the first rate;

wherein disappearance from the media by the first ink is achieved via at least one of evaporation or sublimation and disappearance from the media by the second ink is achieved via at least one of evaporation or sublimation;

wherein the first formulation of ingredients comprises (i) glycerin and (ii) one or more lower boiling point liquids selected from the group consisting of water, methanol, and ethanol;

wherein the second formulation of ingredients comprises (iii) glycerin and (iv) one or more lower boiling point liquids selected from the group consisting of water, methanol, and ethanol; and wherein a first weight ratio of component (i) to component (ii) in the first formulation of ingredients is different from a second weight ratio of component (iii) to component (iv) in the second formulation of ingredients.

2. The method of claim 1, wherein neither the first formulation of ingredients nor the second formulation of ingredients comprises a surfactant.

3. The method of claim 1, wherein component (ii) consists of water.

4. The method of claim 1, wherein component (ii) consists of ethanol.

5. The method of claim 1, wherein component (ii) consists of methanol.

6. The method of claim 1, wherein component (ii) consists of water and ethanol.

7. The method of claim 1, wherein component (ii) consists of water, ethanol, and methanol.

8. The method of claim 1, wherein at least one of the first formulation of ingredients and the second formulation of ingredients comprises from 40 to 70 weight percent of glycerin.

9. The method of claim 1, wherein the first weight ratio is greater than 1 and the second weight ratio is less than 1.

10. The method of claim 1, wherein the first formulation of ingredients consists of 50 weight percent glycerin, 35 weight percent ethanol, and 15 weight percent water.

11. The method of claim 1, wherein the first formulation of ingredients consists of 50 weight percent glycerin and 50 weight percent water.

* * * * *